US006598738B2

(12) United States Patent
Weaver

(10) Patent No.: US 6,598,738 B2
(45) **Date of Patent: *Jul. 29, 2003**

(54) MULTIPLE PROPERTY CONTAINER CARRIER

(75) Inventor: William N. Weaver, Northbrook, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/862,034

(22) Filed: May 21, 2001

(65) Prior Publication Data

US 2002/0011423 A1 Jan. 31, 2002

Related U.S. Application Data

(63) Continuation-in-part of application No. 09/441,705, filed on Nov. 16, 1999, now Pat. No. 6,234,945, which is a continuation of application No. 09/161,131, filed on Sep. 25, 1998, now Pat. No. 6,006,902.

(51) Int. Cl.[7] ..... B65D 75/00

(52) U.S. Cl. ..... 206/150

(58) Field of Search ..... 206/150, 151, 206/158, 147, 153; 294/87.2; 493/328

(56) References Cited

U.S. PATENT DOCUMENTS

| | | | | |
|---|---|---|---|---|
| 3,200,944 A | | 8/1965 | Rapata | |
| 3,341,005 A | | 9/1967 | Poupitch | |
| 4,330,058 A | | 5/1982 | Klygis | |
| 4,356,914 A | | 11/1982 | Olsen et al. | |
| 4,617,223 A | | 10/1986 | Hiscock et al. | |
| 4,846,585 A | | 7/1989 | Boeckmann et al. | |
| 4,911,290 A | | 3/1990 | Karabedian et al. | |
| 4,925,020 A | * | 5/1990 | Gordon | 206/150 |
| 5,065,862 A | | 11/1991 | Mousseau et al. | |
| 5,098,144 A | | 3/1992 | Marvin | |
| 5,305,877 A | | 4/1994 | Olsen | |
| 5,441,147 A | | 8/1995 | Tanner | |
| 5,441,320 A | | 8/1995 | Strong | |
| 5,695,050 A | | 12/1997 | Weaver | |
| 5,868,659 A | | 2/1999 | Slomski | |
| 6,006,902 A | * | 12/1999 | Weaver | 206/150 |
| 6,234,945 B1 | * | 5/2001 | Weaver | 493/330 |

* cited by examiner

*Primary Examiner*—David T. Fidei
(74) *Attorney, Agent, or Firm*—Pauley Petersen Kinne & Erickson

(57) ABSTRACT

A multi-packaging device comprises a plastic sheet having a generally uniform thickness and alternating and discrete strips of different materials extending side-by-side and parallel with respect to an array of apertures, wherein each strip of the alternating and discrete strips of plastic sheet includes at least one distinct physical property that differs from each adjacent strip. Such distinct physical properties may include different moduli, different coefficient of frictions, different colors and/or different recycled material contents.

20 Claims, 4 Drawing Sheets

MULTIPLE PROPERTY CONTAINER CARRIER

CROSS REFERENCE TO RELATED APPLICATION

This application is a continuation-in-part application of U.S. patent application Ser. No. 09/441,705, filed Nov. 16, 1999, now U.S. Pat. No. 6,234,945, which is a continuation of U.S. patent application Ser. No. 09/161,131, filed Sep. 25, 1998, now U.S. Pat. No. 6,006,902.

BACKGROUND OF THE INVENTION

1. Field of the Invention

This invention relates to a multi-packaging device for unitizing and carrying a plurality of containers wherein distinct physical characteristics are present along adjacent strips of material within a plastic sheet.

2. Description of the Prior Art

Multi-packaging devices, such as the device according to this invention, are used to unitize a plurality of containers. Typically, containers include bottles, cans and other containers having a sidewall and a chime or raised rib around an upper portion of the container. Much of the prior art in this area, specifically multi-packaging devices constructed from elastic, polymeric materials, comprises multi-packaging devices that engage the chime or rib around the upper portion of the container. Another style of multi-packaging device is the sidewall applied carrier wherein the multi-packaging device engages the sidewall of the container.

Regardless of the style of multi-packaging device, one challenge in the art is to provide a multi-packaging device that can be used with a range of container sizes, specifically a range of container diameters. Because the container engaging portions of the multi-packaging device are generally elastic, which is governed by the modulus of elasticity or "modulus" of the multi-packaging device, the multi-packaging device relies upon the engagement of a stretched container engaging portion with the container sidewall or chime. Container diameters outside of a narrow range of diameters will either stretch the container engaging portion too much thereby permanently losing elasticity, called "neck-down," or not stretch the container engaging portion at all, both scenarios resulting in package failure.

Prior art multi-packaging devices generally require several different versions or configurations to accommodate different diameters of containers. Typically, a single design multi-packaging device can accommodate a range of container diameters of 0.200 inches. It is therefore desirable to provide a multi-packaging device that can accommodate an increased range of container diameters.

In addition, prior art multi-packaging devices do not permit the flexibility of introducing various physical properties into the composition of the multi-packaging device so as to permit use in a wide variety of applications.

SUMMARY OF THE INVENTION

It is one object of this invention to provide a multi-packaging device that permits the flexibility of introducing various physical properties into the composition of the multi-packaging device so as to permit use in a wide variety of applications.

It is another object of this invention to provide a multi-packaging device that unitizes a plurality of containers into a package that resists movement of the containers relative to each other.

It is another object of this invention to provide a device that unitizes a plurality of containers having a first diameter, which device is also capable of unitizing a plurality of containers having a second diameter.

It is a further object of this invention to provide a device that may be used in a wide range of applications thus obviating production of many different devices of varying size and shape.

It is still another object of this invention to provide a device that is positioned around the sidewall of a container when a sidewall diameter is within an approximately one inch range of diameters.

A multi-packaging device capable of accommodating a range of container diameters is preferably constructed from a thermoplastic material, such as a plastic sheet. A resilient polymer having a lower modulus than the plastic sheet is preferably integrated with the plastic sheet. The resilient polymer preferably forms discrete segments within the plastic sheet so that the multi-packaging device comprises a single, generally linear thickness.

According to another preferred embodiment of this invention, the multi-packaging device may comprise the plastic sheet having a generally uniform thickness and alternating and discrete strips of different materials extending parallel with respect to the array of apertures, wherein each strip of the alternating and discrete strips of plastic sheet includes at least one distinct physical property from each adjacent strip. Preferably, the plastic sheet is coextruded to create a generally uniform thickness that includes alternating and discrete strips of different materials positioned side-by-side and in registry with respect to one another. The distinct physical properties in the adjacent strips of different materials may include any one or more of two different moduli, two different coefficients of friction, two different colors or two different recycled material contents.

The plastic sheet having the integrated resilient polymer is next preferably die-cut to form a plurality of apertures, each aperture capable of receiving a container. The apertures are preferably arranged in an array of lateral rows and longitudinal ranks and formed so that the resilient polymer is adjoining the plastic sheet in one of several preferred locations and/or the adjacent strips of materials are formed in desired locations. In one preferred embodiment of this invention, the resilient polymer is positioned in discrete segments within the plastic sheet and between the apertures in the lateral rows of apertures. In another preferred embodiment of the invention, the resilient polymer or discrete strip of different material is positioned along outer bands in the lateral rows of apertures adjacent to the plastic sheet so that an adjacent strip of material within the plastic sheet is contained in the inner bands of the lateral rows of apertures. In still another preferred embodiment of the invention, the resilient polymer or discrete strip of different material is positioned within the plastic sheet between the apertures in the lateral rows of apertures and contiguous with at least a portion of the perforations.

A container is then inserted into each aperture to form an assembled multi-packaging device and, depending upon the diameter of the container, the plastic sheet and/or the resilient polymer will stretch accordingly. Alternatively or in addition, a portion of the plastic sheet will grip according to its respective coefficient of friction. Additionally, a portion of the plastic sheet may contain a different recycled material content or a different color from that portion in an adjacent strip of different material within the plastic sheet.

BRIEF DESCRIPTION OF THE DRAWINGS

The above-mentioned and other features and objects of this invention will be better understood from the following detailed description taken in conjunction with the drawings wherein.

DESCRIPTION OF THE PREFERRED EMBODIMENTS

Figure 1:
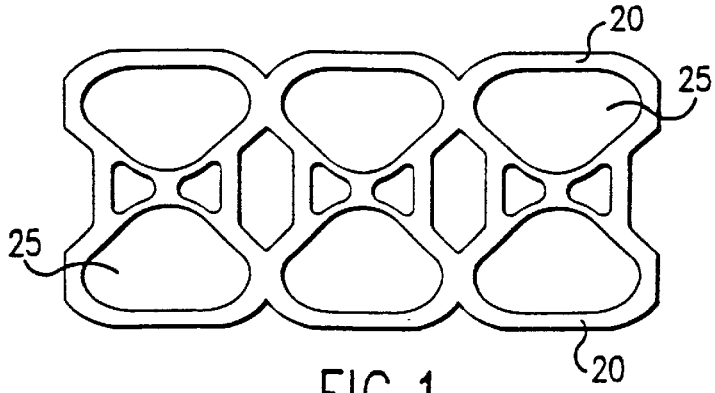
FIG.1 PRIOR ART
FIG. 1 is a top view of a prior art multi-packaging device.

FIG. 1 shows a typical prior art multi-packaging device. As discussed above, the prior art multi-packaging device is capable of accommodating a container diameter range of approximately 0.200 inches. Therefore, numerous embodiments and alterations are required to both the multi-packaging device and the multi-packaging device applicating equipment in order to accommodate a container diameter beyond the 0.200 inch range. Prior art multi-packaging devices are typically constructed from plastic sheet 20 having a single modulus and a plurality of apertures 25. The multi-packaging device shown in FIG. 1 is illustrative of the prior art and shows a device constructed from a single plastic sheet 20 without any additional materials. The physical configuration of the multi-packaging device shown in FIG. 1 may be used in connection with the invention described below.

FIGS. 2, 5, 8 and 11 show multi-packaging device 10 for carrying an array of containers according to four preferred embodiments of this invention. The physical configuration of multi-packaging device 10 shown in FIGS. 2, 5, 8 and 11 are merely illustrative and may be varied without departing from the principles of this invention.

In a manner similar to the types of multi-package carriers described above, multi-packaging device 10 according to one preferred embodiment of this invention is constructed from a thermoplastic material, preferably an extruded low- to medium-density polyethylene sheet material, or plastic sheet 20. As is common in plastic extrusion, plastic sheet 20 is extruded such that a longitudinal direction of plastic sheet 20 is in a machine direction, by definition the direction of the extrusion that is perpendicular to the face of an extrusion die, and the lateral dimension of plastic sheet 20 is in a transverse direction, the direction of the extrusion that is parallel with the extrusion die.

In three preferred embodiments of this invention, shown separately in FIGS. 2–4, 5–7 and 11–13, resilient polymer 40 is integrated, along a single plane, with plastic sheet 20 in multi-packaging device 10 so as to create discrete segments of resilient polymer 40 integrated with respect to plastic sheet 20. Resilient polymer 40 may be coextruded, welded, or otherwise joined with respect to plastic sheet 20 to create a single, linear thickness of multi-packaging device 10. Welded as used in the specification and claims may be defined as a hot weld, cold weld, lamination or other method of joining two materials known to those having ordinary skill in the art.

Figure 4:
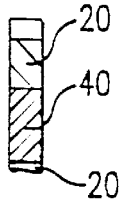
FIG. 4 is a cross-sectional view along section A—A shown in FIG. 3.
Figure 7:
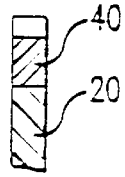
FIG. 7 is a cross-sectional view along section B—B shown in FIG. 6.
Figure 13:
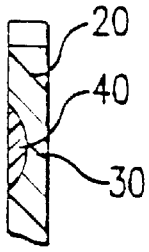
FIG. 13 is a cross-sectional view along section D—D shown in FIG. 12.

Depending upon the methods employed for integrating resilient polymer 40 with plastic sheet 20, resilient polymer 40 and plastic sheet 20 may slightly overlap one another or have slight thickness variations with respect to each other. However, one object of this invention is to produce plastic sheet 20 having a generally uniform thickness with little variation throughout. FIGS. 4, 7 and 13 show cross-sectional views, according to three preferred embodiments of the invention, of multi-packaging device 10 wherein resilient polymer 40 and plastic sheet 20 form a single thickness multi-packaging device 10 containing two separate materials. It is desirable to use resilient polymer 40 that is compatible with plastic sheet 20 for reprocessing and recycling purposes.

Resilient polymer 40 preferably has a lower modulus than the modulus of plastic sheet 20 and is thus more elastic than plastic sheet 20. Therefore, resilient polymer 40 preferably stretches a greater amount than plastic sheet 20 when exposed to an equal stress as plastic sheet 20. As used throughout the specification and claims, a material having a lower modulus has more elasticity than a material having a higher modulus. Although carrier 10 may be constructed entirely from a material having a lower modulus such as resilient polymer 40, the cost of such carrier 10 is prohibitive for extensive commercial use.

Figure 8:
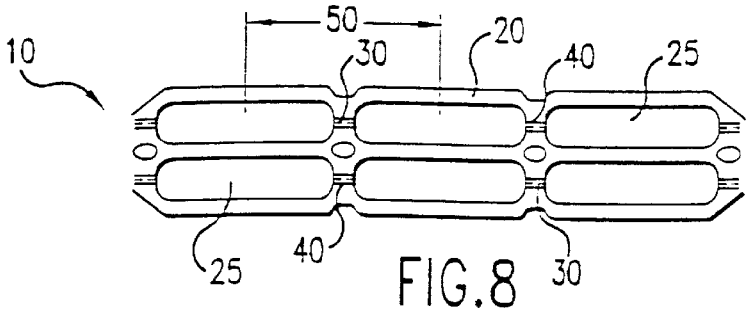
FIG. 8 is a diagrammatic top view of the multi-packaging device according to one preferred embodiment of the invention.
Figure 9:
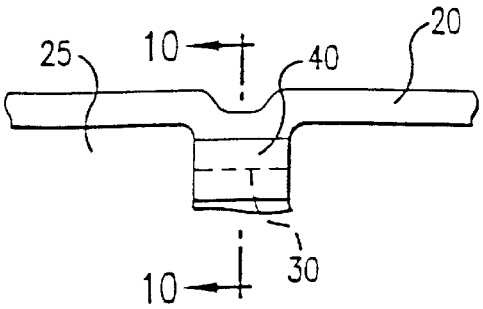
FIG. 9 is a diagrammatic enlarged view of a portion of the multi-packaging device shown in FIG. 8.
Figure 10:
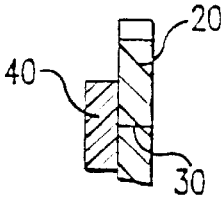
FIG. 10 is a cross-sectional view along section C—C shown in FIG. 9.

In one preferred embodiment of this invention, shown in FIGS. 8–10, a plurality of longitudinally arranged lines of weakness, preferably perforations 30, are positioned in plastic sheet 20 at predetermined intervals along plastic sheet 20. Perforations 30 may be added with a perforation wheel or some other means of perforating plastic sheet 20 known to those having reasonable skill in the art. In another preferred embodiment of this invention, perforations 30 may be replaced with some other means of weakening plastic sheet 20 such as reducing a thickness of plastic sheet 20 along similar longitudinal lines.

In a preferred embodiment of this invention shown in FIGS. 8–10, resilient polymer 40 is positioned on plastic sheet 20 contiguous with at least a portion of perforations 30. As shown in FIG. 8, in an enlarged view in FIG. 9, and in cross-section in FIG. 10, in one preferred embodiment of this invention, resilient polymer 40 is positioned completely over the line of perforations 30 in plastic sheet 20. Resilient polymer 40 may be laminated on plastic sheet 20, extrusion coated on plastic sheet 20 or co-extruded with plastic sheet 20. Alternatively, resilient polymer 40 may be sprayed, taped, roller coated or otherwise applied to plastic sheet 20 using processing techniques known to those skilled in the art. In this preferred embodiment of the invention, resilient polymer 40 and plastic sheet 20 form a cross-section, shown in FIG. 10 as section C—C from FIG. 9, having a greater thickness than plastic sheet 20 alone. Resilient polymer 40 is preferably applied to plastic sheet 20 prior to stamping individual multi-packaging device 10.

Figure 11:
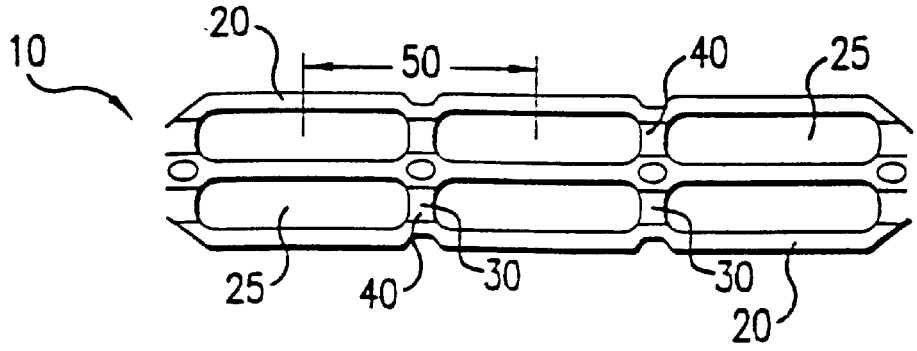
FIG. 11 is a is a diagrammatic top view of the multi-packaging device according to one preferred embodiment of the invention.
Figure 12:
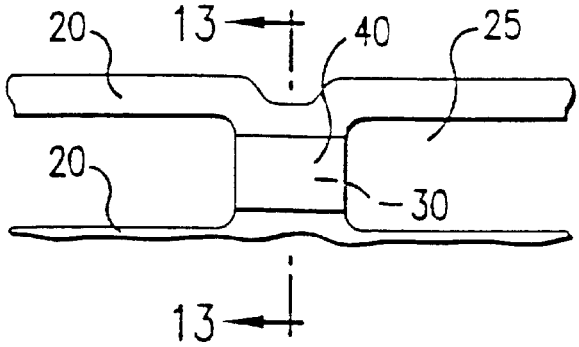
FIG. 12 is a diagrammatic enlarged view of a portion of the multi-packaging device shown in FIG. 11.

In one preferred embodiment shown in FIGS. 11–13, resilient polymer 40 is co-extruded, or otherwise integrated, with plastic sheet 20 to form a cross-section, shown in FIG. 13 as section D—D from FIG. 12. As shown in FIG. 13, plastic sheet 20 has a reduced thickness forming a channel comprising resilient polymer 40.

After resilient polymer 40 is integrated with, or applied to, plastic sheet 20, the resulting material sheet is preferably stamped or die-cut to create individual multi-packaging devices 10. Although as described, plastic sheet 20 is die-cut after the integration of plastic sheet 20 and resilient polymer 40, plastic sheet 20 may be die-cut before the addition of either or both of line of weakness 30 and resilient polymer 40 for the preferred embodiment of this invention shown in FIGS. 8–10 and described above. Plastic sheet 20 is preferably formed using a punch press to die cut and extract material and create the features of multi-packaging device 10 described below.

Plastic sheet 20 having integrated resilient polymer 40 is die-cut to form a plurality of apertures 25, each aperture 25 capable of receiving a container. Apertures 25 are preferably arranged in an array of lateral rows and longitudinal ranks. As shown in FIGS. 2, 5, 8 and 11, a preferable array is an arrangement of two lateral rows and three longitudinal ranks to form multi-packaging device 10 for holding six containers. Accordingly, rows of apertures 25, although extending lengthwise across plastic sheet 20, are counted laterally across a width of plastic sheet 20 and ranks of apertures 25, although extending widthwise across plastic sheet 20, are counted longitudinally along a length of plastic sheet 20. It should be noted, however, that although FIGS. 2, 5, 8 and 11 show multi-packaging device 10 for holding six containers, the invention is not intended to be so limited and multi-packaging device 10 may contain any feasible array of apertures 25.

Figure 2:
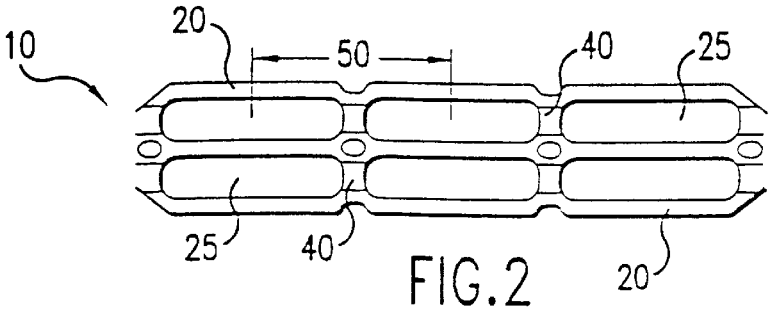
FIG. 2 is a diagrammatic top view of the multi-packaging device according to one preferred embodiment of the invention.
Figure 3:
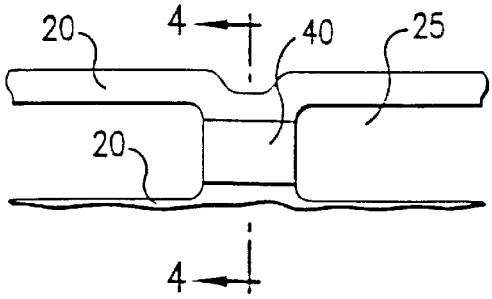
FIG. 3 is a diagrammatic enlarged view of a portion of the multi-packaging device shown in FIG. 2.

In one preferred embodiment of this invention, shown in FIGS. 2 and 11, apertures 25 are formed so that resilient polymer 40 is longitudinally arranged and positioned between apertures 25 in the lateral rows of apertures 25. This configuration permits resilient polymer 40 to stretch in high stress areas between apertures 25 and avoids the tendency of plastic sheet 20 in that area to neck-down.

Apertures 25 are preferably ovals arranged with a major axis of aperture 25 extending in the longitudinal direction. However, apertures 25 may comprise any opening, preferably, though not necessarily, an elongated opening having an elongation in the longitudinal direction. As shown in FIGS. 2, 5, 8 and 11, apertures 25 are narrower in the lateral direction than prior art apertures, as shown in FIG. 1. Narrower apertures 25 permit the manufacture of additional lanes of multi-packaging devices 10 using the same amount of lateral sheet material used in prior art multi-packaging devices.

Figure 5:
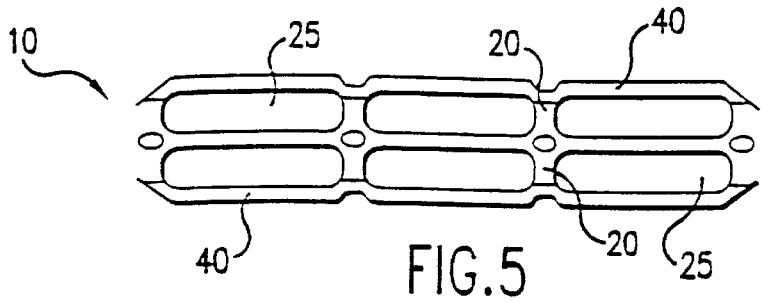
FIG. 5 is a diagrammatic top view of the multi-packaging device according to another preferred embodiment of the invention.
Figure 6:
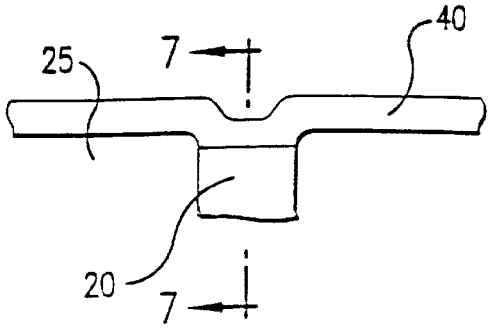
FIG. 6 is a diagrammatic enlarged view of a portion of the multi-packaging device shown in FIG. 5.

In another preferred embodiment of this invention, shown in FIG. 5, apertures 25 are formed so that resilient polymer 40 is longitudinally arranged and positioned along outer bands of the lateral rows of apertures 25 in multi-packaging device 10. The outer bands of the lateral rows of apertures 25 are approximately that portion of multi-packaging device 10 visible along a perimeter of an assembled multi-packaging device 10 with containers engaged with apertures 25. This configuration permits resilient polymer 40 to stretch to accommodate multiple container diameters but still allows plastic sheet 20, having the higher modulus, to absorb the larger stresses present in the central area of multi-packaging device 10.

In another preferred embodiment of this invention, shown in FIG. 8, apertures 25 are formed so that line of weakness 30, such as perforations, and therefore also resilient polymer 40, are longitudinally arranged and positioned between apertures 25 in the lateral rows of apertures 25. In this preferred embodiment of this invention, the line of perforations or other line of weakness 30 bisects a minor axis of apertures 25, or other longitudinal direction of aperture 25. Depending upon the physical properties of plastic sheet 20 and resilient polymer 40, line of weakness 30, such as perforations or a reduced thickness of plastic sheet 20, may be offset with respect to a center of the minor axis of apertures 25 to attain the desired characteristics.

In yet another preferred embodiment of this invention, shown in FIG. 11, apertures 25 are formed so that resilient polymer 40 is longitudinally arranged and positioned between apertures 25 in the lateral rows of apertures 25. However, resilient polymer 40 may be co-extruded in any other position within carrier 10 that results in preferable stretching characteristics.

In a specific current embodiment of this invention, multi-packaging device 10 may contain apertures 25 having pitch 50 of approximately 3 inches. Pitch 50 is a dimension between a center point of adjacent apertures 25 in the longitudinal rows. Pitch 50 dimension is important because that dimension must be maintained for use of multi-packaging device 10 on conventional applicating equipment used to apply multi-packaging device 10 onto containers. A constant pitch 50 within multi-packaging device 10 allows the use of a single style of applicating equipment for use with a range of container diameters. In prior art multi-packaging devices, maintaining pitch 50 dimension required altering multi-packaging device 10 in other dimensions in order to accommodate different container diameters.

Resilient polymer 40 preferably has a lower modulus than the modulus of plastic sheet 20 and is thus more elastic than plastic sheet 20. In one preferred embodiment of this invention, resilient polymer 40 is a metallocene or polyolefin plastomer. Resilient polymer 40 may comprise any other material known to those having ordinary skill in the art and exhibiting such characteristics as high stretch, low modulus and high clarity.

In the preferred embodiments of the invention shown in FIGS. 2–7, when containers are inserted into multi-packaging device 10 to create an assembled multi-packaging device 10, containers having small diameters will cause multi-packaging device 10 to stretch resilient polymer 40. As larger diameter containers are inserted into multi-packaging device 10, plastic sheet 20 and resilient polymer 40 will stretch until reaching a predetermined stress level at which level resilient polymer 40 will become strain-hardened and thus stretch at a disproportionately slower level than plastic sheet 20. In this manner, multi-packaging device 10 can unitize and engage a range of container diameters without loss of elasticity, or neck-down, of either plastic sheet 20 or resilient polymer 40.

In a preferred embodiment of the invention having longitudinal lines of weakness 30 such as perforations, shown in FIGS. 8–10, or a reduced thickness of plastic sheet 20 forming line of weakness 30, shown in FIGS. 11–13, when containers are inserted into multi-packaging device 10, line of weakness 30 may rupture depending upon the induced lateral stress exerted on plastic sheet 20. However, multi-packaging device 10 will remain in operative condition because resilient polymer 40 will maintain its elasticity and thus the elasticity of the entire multi-packaging device 10. This effects a more sudden transition from the modulus of plastic sheet 20 to the modulus of resilient polymer 40 than the embodiments of the invention wherein plastic sheet 20 and resilient polymer 40 are linearly integrated.

Multi-packaging device 10 will therefore unitize groups of containers having a range of diameters. Typical current containers, specifically bottles, have diameters that range between approximately 2.6 inches and approximately 2.9 inches. Multi-packaging device 10 according to this invention will permit a single size device to engage a relatively broad range of existing and conceivable containers.

Multi-packaging device 10 is preferably sized based upon the modulus of plastic sheet 20 to be used for the smallest container diameter in the acceptable range of container diameters, such as a current low-end container diameter of 2 inches. The stretch properties, and relative modulus, of resilient material 40 is determined from the largest container diameter in the acceptable range of container diameters, such as a current high-end container diameter of 3 inches. Pitch 50 is sized to accommodate the largest container diameter, for example 3 inches, within the acceptable range of container diameters. Apertures 25 in a center portion of multi-packaging device 10 may require a smaller size than apertures in an outer portion of multi-packaging device 10 to minimize "puckering" in an assembled multi-packaging device 10.

Figure 14:
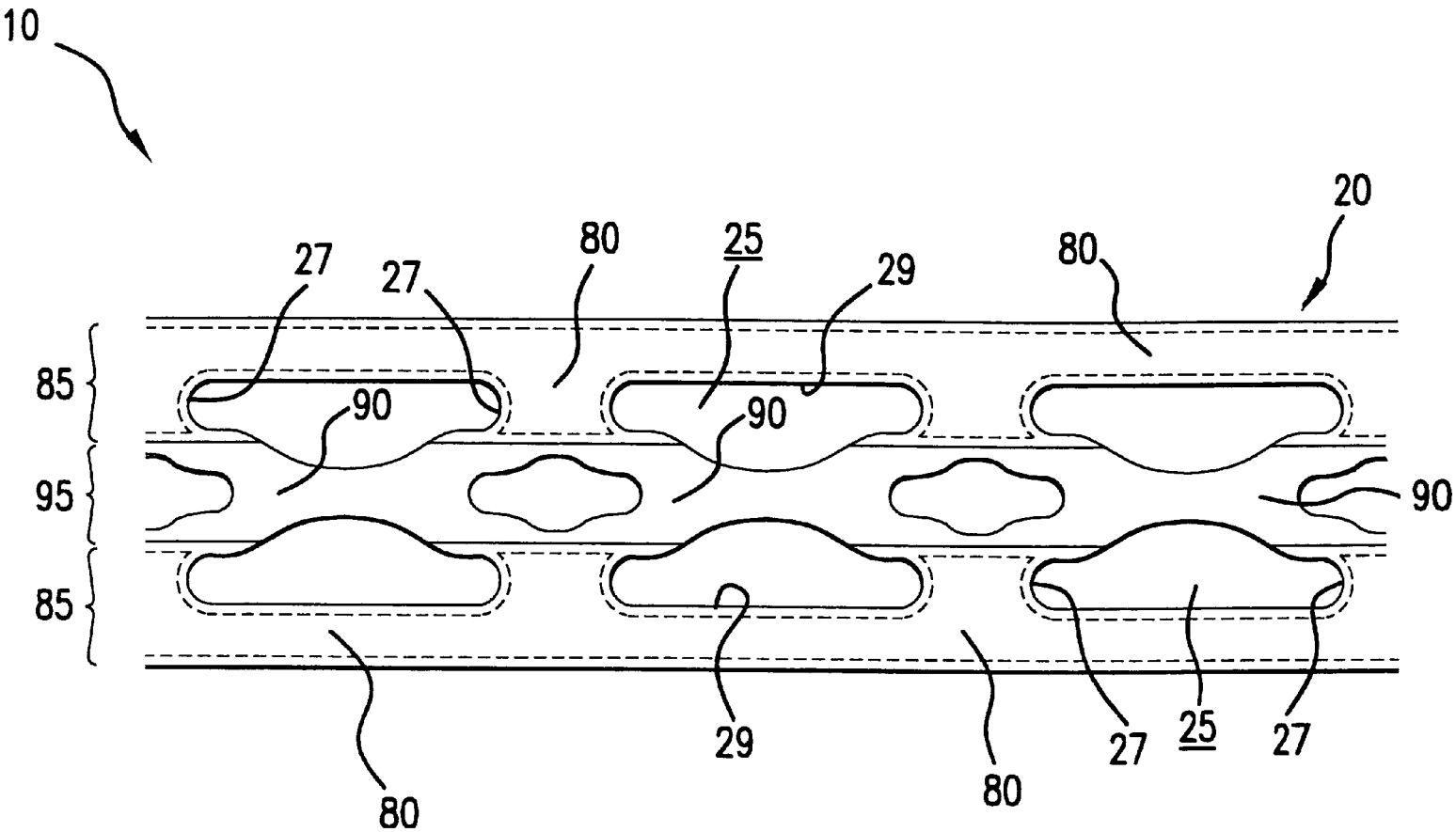
FIG. 14 is a is a diagrammatic top view of the multi-packaging device according to one preferred embodiment of the invention.

According to one preferred embodiment of this invention, multi-packaging device 10 may comprise plastic sheet 20 having a generally uniform thickness made of alternating and discrete strips of different material extending side-by-side and parallel with respect to the array of apertures 25, wherein each strip of the alternating and discrete strips of plastic sheet 20 includes at least one distinct physical property that differs from each adjacent strip. FIG. 14 generally shows an arrangement of multi-packaging device 10 wherein alternating and discrete strips of material are formed within plastic sheet 20. Preferably, plastic sheet 20 is coextruded to create a generally uniform thickness that includes alternating and discrete strips of different materials positioned side-by-side and in registry with respect to one another.

As described in detail herein, at least one of the distinct physical properties present in adjacent strips of the alternating and discrete strips of material may be a modulus of elasticity or "modulus." Therefore, each strip of material within plastic sheet 20 may have a different modulus from each adjacent strip.

Another distinct physical property that may be present in adjacent strips of material within plastic sheet 20 is a coefficient of friction. Therefore, each strip of material within plastic sheet 20 may have a higher or lower coefficient of friction, and thus be more or less "sticky," than each adjacent strip.

Another distinct physical property that may be present in adjacent strips of material within plastic sheet 20 is a content of recycled material. As used herein, virgin material includes pelletized raw material in pure form and regrind from scrap removed from plastic sheet 20 during the manufacturing process. As a result, the term virgin material includes all in-plant material including regrind. Recycled material as used herein is defined as recycled raw material obtained from secondary sources wherein original uses of such raw materials did not include manufacture of multi-packaging devices. Therefore, each strip of material within plastic sheet 20 may have a greater or lesser concentration of recycled material than each adjacent strip. Alternatively, one strip of material may include exclusively virgin material and one or more adjacent strips of material may include recycled material.

Another distinct physical property that may be present in adjacent strips of material within plastic sheet 20 is a color. Therefore, each strip of material within plastic sheet 20 may have a different color from each adjacent strip.

The aforementioned physical properties may be individually present within plastic sheet 20 or may be mixed and matched within plastic sheet 20 to form customized multi-packaging devices 10 depending upon the desired application. Therefore, a multi-packaging device 10 according to this invention may have alternating strips of material that, for instance, each have distinct moduli and distinct coefficients of friction or have distinct recycled material content and distinct color.

According to one preferred embodiment of this invention as shown in FIG. 14, multi-packaging device 10 includes one of the different materials positioned along each of the outer bands 85 in lateral rows of the array of apertures 25 thereby forming a total of three alternating and discrete strips of different material. As shown, a strip of the alternating and discrete strips is thereby positioned along a longitudinal line of inner portion 95 of the package between apertures 25 in the array of apertures. As a result, when containers are assembled into a completed package, one strip of material in plastic sheet 20 is positioned along an inner portion 95 of the package and the adjacent strips of plastic sheet 20 is positioned on outer portion 85 of the package.

According to a specific preferred embodiment of this invention, multi-packaging device 10 includes plastic sheet 20 having a plurality of container receiving apertures 25 arranged in adjacent rows and ranks. A first portion of plastic sheet 20 preferably has a first coefficient of friction and a first modulus and a second portion of plastic sheet 20 has a second coefficient of friction and a second modulus, wherein the first coefficient of friction is different than the second coefficient of friction and the first modulus is different than the second modulus. As described above, the first portion of plastic sheet 20 preferably forms a strip along a length of multi-packaging device 10.

When the preceding embodiment of multi-packaging device 10 is assembled into a package, the plurality of interconnected bands formed by plastic sheet 20 are positioned approximately 1" from the top of the containers. The package in this embodiment also provides a greater can resistance along the portions of the plastic sheet 20 that include the first coefficient of friction, specifically along a middle portion of plastic sheet 20 extending between apertures 25. Can resistance as used in this specification and claims is defined as the amount of resistance the plastic sheet provides as a generally smooth container is slid along the surface. Accordingly, the first coefficient of friction provides approximately double or triple the can resistance from the second coefficient of friction.

One basis for the embodiment described above is to optimize the physical properties of plastic sheet 20 depending upon the position of critical stress areas 80 and non-critical stress areas 90 of the package. The dashed lines in FIG. 14 provide a general indication of critical stress areas 80 and non-critical stress areas 90 for one particular multi-packaging device 10. Critical stress areas 80 are generally found in areas of plastic sheet 20 that are stretched around and then retain containers. For instance, as shown by the dashed lines in FIG. 14, critical stress areas 80 extend at least partially around the extremities 27 of aperture 25 and further along an outer region 29 of aperture 25 that border outer bands 85 of multi-packaging device 10.

The critical stress areas 80 are preferably comprised of a material that can stretch and recover. Generally, virgin material will more likely have recovery properties of this sort than recycled material. The modulus of the material may also affect the material's ability to stretch and recover. In other configurations of apertures 25 and/or of multi-packaging devices 10, critical stress areas 80 may differ from those shown generally by dashed lines in FIG. 14.

Non-critical stress areas 90 generally are not stressed as much as critical stress areas 80 during and after application to containers. In practice, a portion of plastic sheet having the non-critical stress areas 90, such as inner portion 95, may include a lower coefficient of friction or a higher recycled material content than the critical stress areas 80. According to one preferred embodiment of this invention, the position of the strip of the alternating and discrete strips positioned along inner portion 95 of multi-packaging device 10 is defined by the relative location of the critical stress areas 80. Therefore, the strip positioned along inner portion 95 of multi-packaging device 10 is configured based upon how stresses are applied to multi-packaging device 10 during application to containers. Optimally, as shown in FIG. 14, the strip positioned along inner portion 95 of multi-packaging device 10 coincides with non-critical stress areas 90 of multi-packaging device 10.

While in the foregoing specification this invention has been described in relation to certain preferred embodiments thereof, and many details have been set forth for purposes of illustration, it will be apparent to those skilled in the art that the apparatus is susceptible to additional embodiments and that certain of the details described herein can be varied considerably without departing from the basic principles of the invention.

I claim:

1. A multi-packaging device for carrying an array of containers in a corresponding array of apertures, the multi-packaging device comprising:

a plastic sheet having a generally uniform thickness made of alternating and discrete strips of different material extending side-by-side and parallel relative to each other and to the array of apertures, the array of apertures extending longitudinally across the plastic sheet, wherein each strip of the alternating and discrete strips of the plastic sheet includes at least one distinct physical property that differs from each adjacent strip.

2. The multi-packaging device of claim 1 wherein the at least one distinct physical property is a modulus.

3. The multi-packaging device of claim 1 wherein the at least one distinct physical property is a coefficient of friction.

4. The multi-packaging device of claim 1 wherein the at least one distinct physical property is a recycled material content.

5. The multi-packaging device of claim 1 wherein the at least one distinct physical property is color.

6. The multi-packaging device of claim 1 wherein one of the different materials is positioned along outer bands in lateral rows of the array of apertures.

7. The multi-packaging device of claim 1 wherein the alternating and discrete strips of different material are coextruded to form the plastic sheet.

8. A multi-packaging device for unitizing an array of containers, the device comprising:

a sheet having a plurality of container receiving apertures arranged in adjacent rows and ranks;

a first portion of the sheet having a first coefficient of friction and a first modulus; and a second portion of the sheet having a second coefficient of friction and a second modulus, the first coefficient of friction being different than the second coefficient of friction and the first modulus being different than the second modulus, the first portion and the second portion formed in alternating and discrete strips extending side-by-side and parallel relative to each other along a length of the multi-packaging device.

9. The multi-packaging device of claim 8 wherein the first coefficient of friction is less than the second coefficient of friction and the first modulus is greater than the second modulus.

10. A package of containers comprising:

a sheet having a plurality of interconnected bands forming an array of container receiving apertures extending longitudinally across the sheet, the sheet having a generally uniform thickness made of alternating and discrete strips of different material extending side-by-side and parallel relative to each other and to the array of apertures, wherein each strip of the alternating and discrete strips of the plastic sheet includes at least one distinct physical property that differs from each adjacent strip;

a first portion of the sheet having a first coefficient of friction;

a second portion of the sheet having a second coefficient of friction, the first portion of the sheet and the second portion of the sheet coinciding with different strips of the alternating and discrete strips; and a plurality of containers, each container of the plurality of containers positioned within a container receiving aperture of the array so that the first portion of the sheet is positioned on an inner portion of the package and the second portion of the sheet is positioned on an outer portion of the package.

11. The package of claim 10 wherein the first portion of the sheet coincides with a material having a first modulus and the second portion of the sheet coincides with a material having a second modulus.

12. The package of claim 10 wherein the first coefficient of friction provides approximately double a can resistance from the second coefficient of friction.

13. The package of claim 10 wherein the first coefficient of friction provides approximately triple a can resistance from the second coefficient of friction.

14. A package of containers comprising:

a plastic sheet having a generally uniform thickness made of alternating and discrete strips of different material extending side-by-side and parallel with respect to each other and an array of apertures, wherein each strip of the alternating and discrete strips of the plastic sheet includes at least one distinct physical property that differs from each adjacent strip;

a plurality of containers, each container of the plurality of containers positioned within an aperture of the array so that one strip of the plastic sheet is positioned along an inner portion of the package and adjacent strips to the one strip are positioned along an outer portion of the package.

15. The package of claim 14 wherein the at least one distinct physical property is a modulus.

16. The package of claim 14 wherein the at least one distinct physical property is a coefficient of friction.

17. The package of claim 14 wherein the at least one distinct physical property is a recycled material content.

18. The package of claim 14 wherein the at least one distinct physical property is color.

19. A multi-packaging device for unitizing an array of containers, the device comprising:

a sheet having a plurality of container receiving apertures arranged in adjacent rows and ranks, the sheet having critical stress areas and non-critical stress areas and formed in adjacent, side-by-side, parallel strips of recycled material and virgin material;

a portion of the sheet having the non-critical stress areas including recycled material.

20. The multi-packaging device of claim 19 wherein the adjacent strips contain at least one of two different coefficients of friction, two different moduli and two different colors within the sheet.

* * * * *